United States Patent [19]

Morrison

[11] Patent Number: 4,942,730

[45] Date of Patent: Jul. 24, 1990

[54] TEXTILE APPARATUS

[75] Inventor: William A. Morrison, Carnmoney, Northern Ireland

[73] Assignee: James Mackie & Sons Limited, Belfast, Northern Ireland

[21] Appl. No.: 232,712

[22] Filed: Aug. 16, 1988

[30] Foreign Application Priority Data

Aug. 17, 1987 [GB] United Kingdom ..... 8719416

[51] Int. Cl.[5] ..... D01H 1/38; D01H 9/16; D01H 11/00

[52] U.S. Cl. ..... 57/303; 57/305; 57/306; 242/18 EW

[58] Field of Search ..... 57/278, 299, 303, 305, 57/306, 304; 242/18 PW, 18 EW

[56] References Cited

U.S. PATENT DOCUMENTS

| | | | |
|---|---|---|---|
| 1,822,415 | 9/1931 | Niogret | 57/303 |
| 2,800,762 | 7/1957 | Würmli | 57/305 X |
| 3,067,565 | 12/1962 | Jackson | 57/278 |
| 3,186,154 | 6/1965 | Negishi | 57/278 |
| 3,312,051 | 4/1967 | Schumann et al. | 57/306 X |
| 3,339,356 | 9/1967 | Nikel et al. | 57/299 |
| 3,374,616 | 3/1968 | Hidden et al. | 57/305 X |
| 3,530,657 | 9/1970 | Grau | 57/303 |
| 3,948,029 | 4/1976 | Bridle et al. | 57/278 X |
| 4,133,168 | 1/1979 | Keller et al. | 57/305 X |

FOREIGN PATENT DOCUMENTS

| | | | |
|---|---|---|---|
| 47431 | 3/1984 | Japan | 57/303 |

*Primary Examiner*—Joseph J. Hail, III

*Attorney, Agent, or Firm*—Wood, Herron & Evans

[57] ABSTRACT

A textile yarn ring spinning or twisting apparatus of the type comprising a spindle for carrying a yarn support tube, the spindle being rotatable about its axis to enable yarn to be wound on the tube to form a yarn package, a yarn reserve winding member around which yarn may be wound prior to the doffing of a wound package from the spindle, and a yarn severing device so positioned adjacent the axis of the spindle and between the reserve winding member and an adjacent portion of the spindle on which the end of the package is located as to engage yarn extending from the reserve winding member to the wound package on the spindle. In accordance with the invention the drive mechanism enables relative rotation between the reserve winding member and the severing device so that the length of yarn extending from the package on the spindle to the reserve winding member may be severed.

12 Claims, 6 Drawing Sheets

TEXTILE APPARATUS

IMPROVEMENTS IN AND RELATING TO TEXTILE APPARATUS

Figure 1:
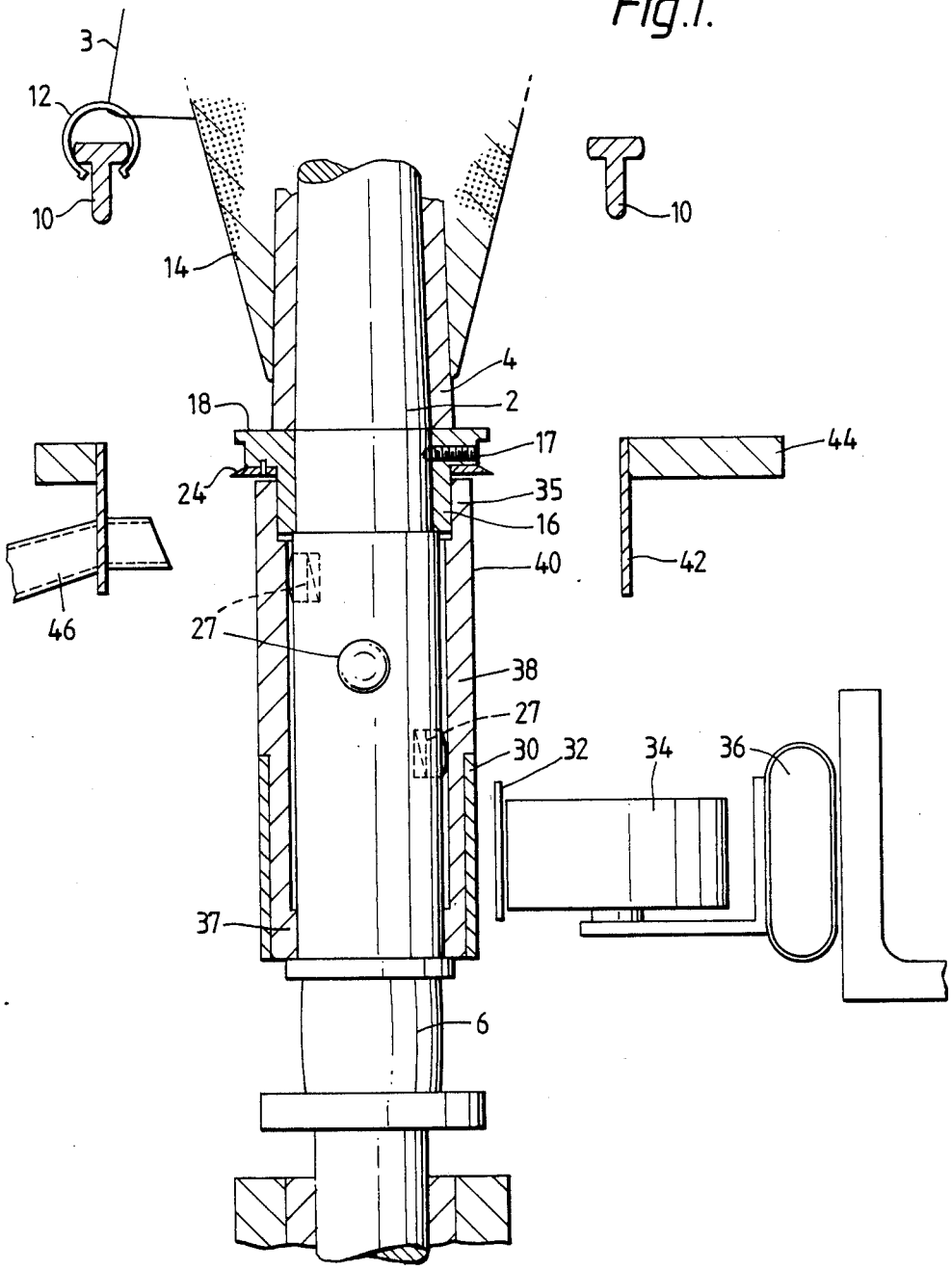
Figure 2:
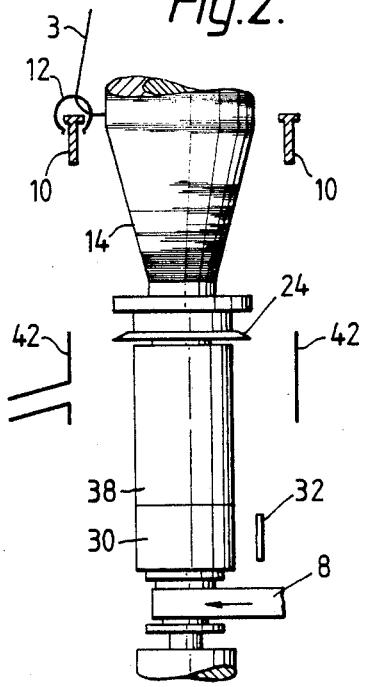
Figure 3:
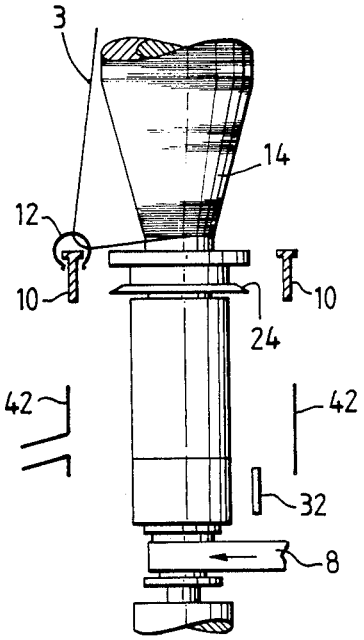
Figure 4:
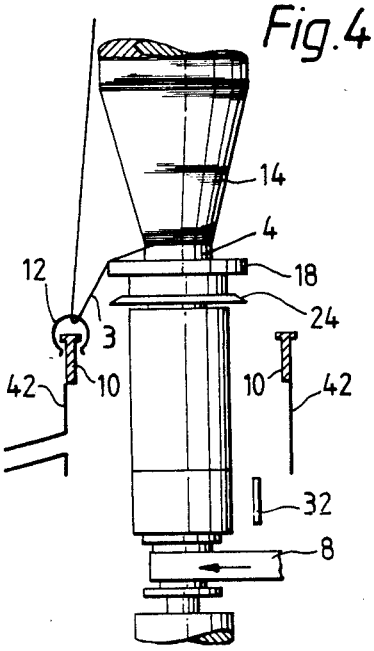
Figure 5:
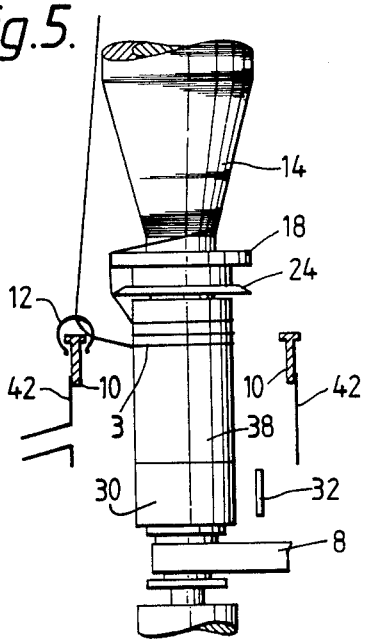
Figure 6:
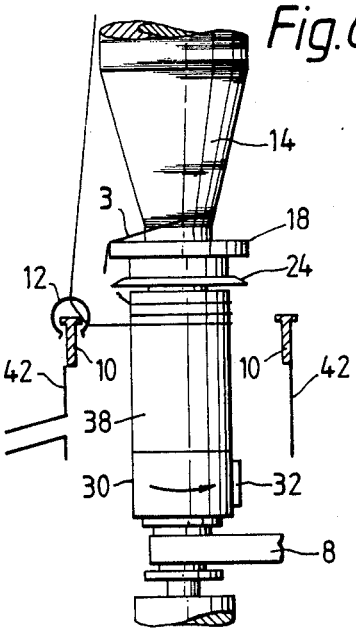
Figure 7:
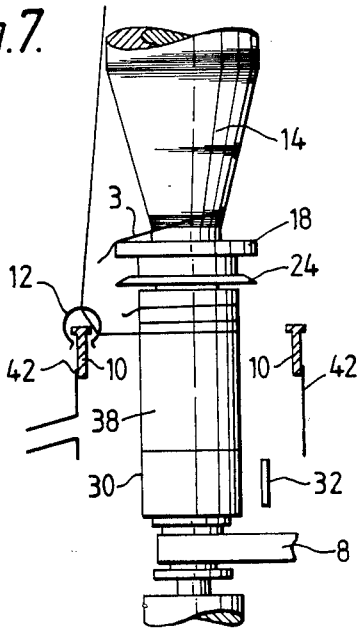
Figure 8:
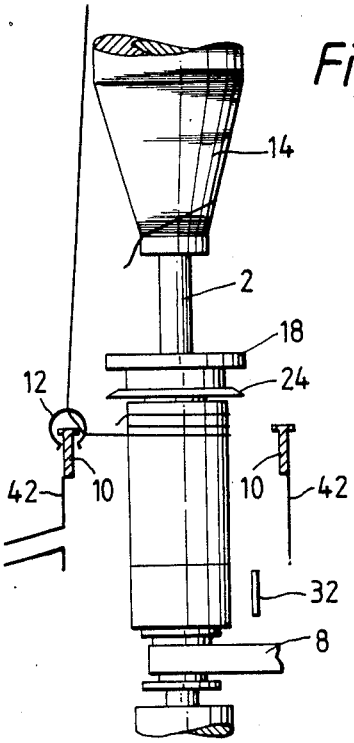
Figure 9:
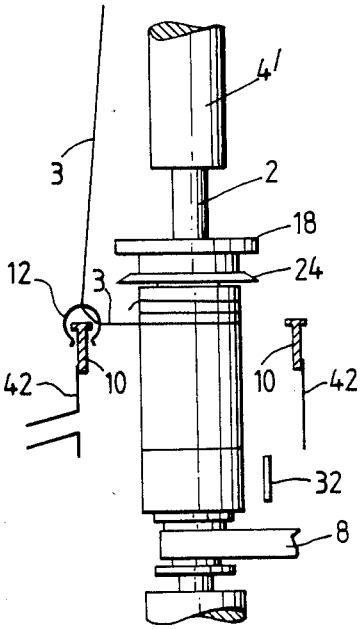
Figure 10:
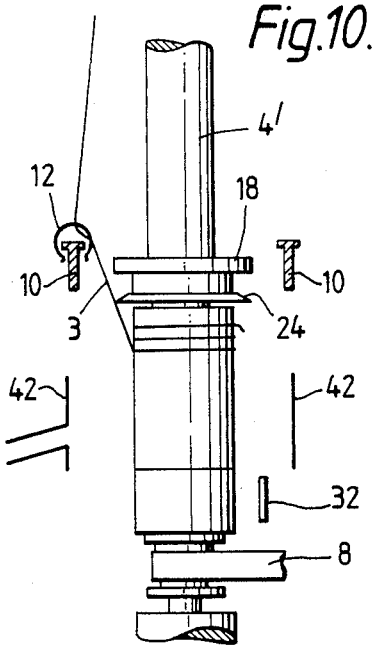

This invention relates to textile yarn ring spinning, twisting or doubling apparatus wherein the yarn is wound on a support tube carried by a driven spindle, the yarn being wound around the tube to form a yarn package. The term "textile yarn" is intended to encompass both natural and artificial material including filaments. The invention may be particularly advantageously practised in textile machines of the ring spinning and twisting type which have driven spindles and are provided with automatic bobbin doffing and donning apparatus.

In each case the yarn is delivered by rollers and then fed on to the rotating tube or bobbin mounted on a spindle, means being provided to cause the yarn to be wound evenly on the said tube or bobbin. In the case of a ring spinning apparatus for example, a traveller is carried by a ring which is normally stationary but which may rotate the yarn from the delivery rollers passing through the traveller on to the spindle. In operation either the spindle may gradually move axially relative to the ring or the ring to the spindle so that the yarn package is formed along the length of the tube on the spindle this movement being superimposed upon a relative reciprocating movement over the length of the nose of the package.

When the package has reached its predetermined size it is known practice to move the rail carrying the ring (or the spindle) axially relative to the spindle or ring respectively so that a few turns of yarn are wound around an extension of the spindle below the tube. This is known as the underwind (undercoils or reserve windings). The yarn connecting the underwind and the full package must then be broken or severed to enable the full package to be cleanly removed from the spindle.

When the wound package is doffed and a fresh tube or bobbin is refixed on the spindle, the ring rail is moved back in position to form a new yarn package on the new tube. The yarn leading from the underwind is thus connected to the first few windings around the new tube, after which the connecting length of yarn is severed. It has been proposed that the severing operation be carried out by a cutter mounted on the spindle.

However, such cutters are not, normally, renowned for their efficiency and even if only a few of the yarns remain unsevered then the benefit of automatic doffing and donning apparatus, which to merit its capital cost must significantly reduce labour costs, may be lost.

A further disadvantage encountered with such cutting devices is that the underwind is left around the spindle extension and this accumulates as successive packages are wound.

It is time consuming to remove these underwinds but if they are allowed to accumulate, the spinning or winding operation can be disrupted.

It is a general object of this invention to provide the answers to these problems.

A textile yarn winding, ring spinning apparatus or the like in accordance with one feature of this invention has a spindle for carrying a yarn support tube which is rotated about the axis of the spindle to enable yarn to be wound on the tube to form a yarn package, a yarn reserve winding member being provided, preferably as a spindle extension and around which the yarn is wound prior to a completed package being doffed from the spindle and a yarn severing device preferably located along the axis of the spindle between the reserve winding member and the adjacent portion of the spindle at which the end of the package is located characterised in that drive means are arranged to provide relative rotation between the reserve winding member and the severing device so as to be able to sever a length of yarn extending from the package or tube on the spindle, to the reserve winding member.

Preferably the reserve winding member is rotatably mounted upon an extension of the spindle beneath the package and is capable of rotation relative to the spindle. The severing device may also be mounted for rotation upon the spindle extension.

The drive means which provides the relative rotation between the reserve winding member and the severing device is preferably separate from the spindle drive and can be activated as and when desired.

In accordance with a further feature of this invention, waste yarn extraction means, preferably suction means, are provided positioned, at the appropriate time, adjacent the reserve winding member so that waste pieces of yarn wrapped around the reserve winding member and preferably unwound by the rotation of the yarn reserve member relative to the spindle and the suction supplied by the extraction means. The suction device may form part of a cover which during normal operation of the machine guards the severing device and which can be moved to a position apart from the reserve winding member during the period when the reserve windings are being wound on the reserve winding member.

In accordance with a further feature of apparatus in accordance with the invention, such apparatus incorporates a spindle assembly comprising a spindle for carrying a yarn support tube, a yarn severing device mounted upon the spindle, and a reserve winding member mounted upon the spindle and/or the severing device or a support for the reserve winding member separate from the spindle, the reserve winding member and/or the severing device being capable of rotation relative to the spindle and/or to the other.

With the apparatus of the invention the yarn connecting the first few turns on a new yarn package support tube and the reserve windings is cut by the relative rotation of the reserve winding member and the severing device and the reserve windings left on the reserve winding member after the cutting operation may be cleanly removed from the yarn reserve member by suction means during a counter-rotation of the yarn reserve winding member relative to the spindle.

Preferably the severing device is fixed to the spindle so as to rotate with it and the reserve winding member is also mounted on the spindle so as to rotate with it during the winding of the reserve windings (undercoils) but is also capable of being driven to rotate about the spindle when the connecting yarn between the package or tube and the reserve winding member is to be cut or when the waste undercoils are to be removed from the reserve winding member.

Figure 18:
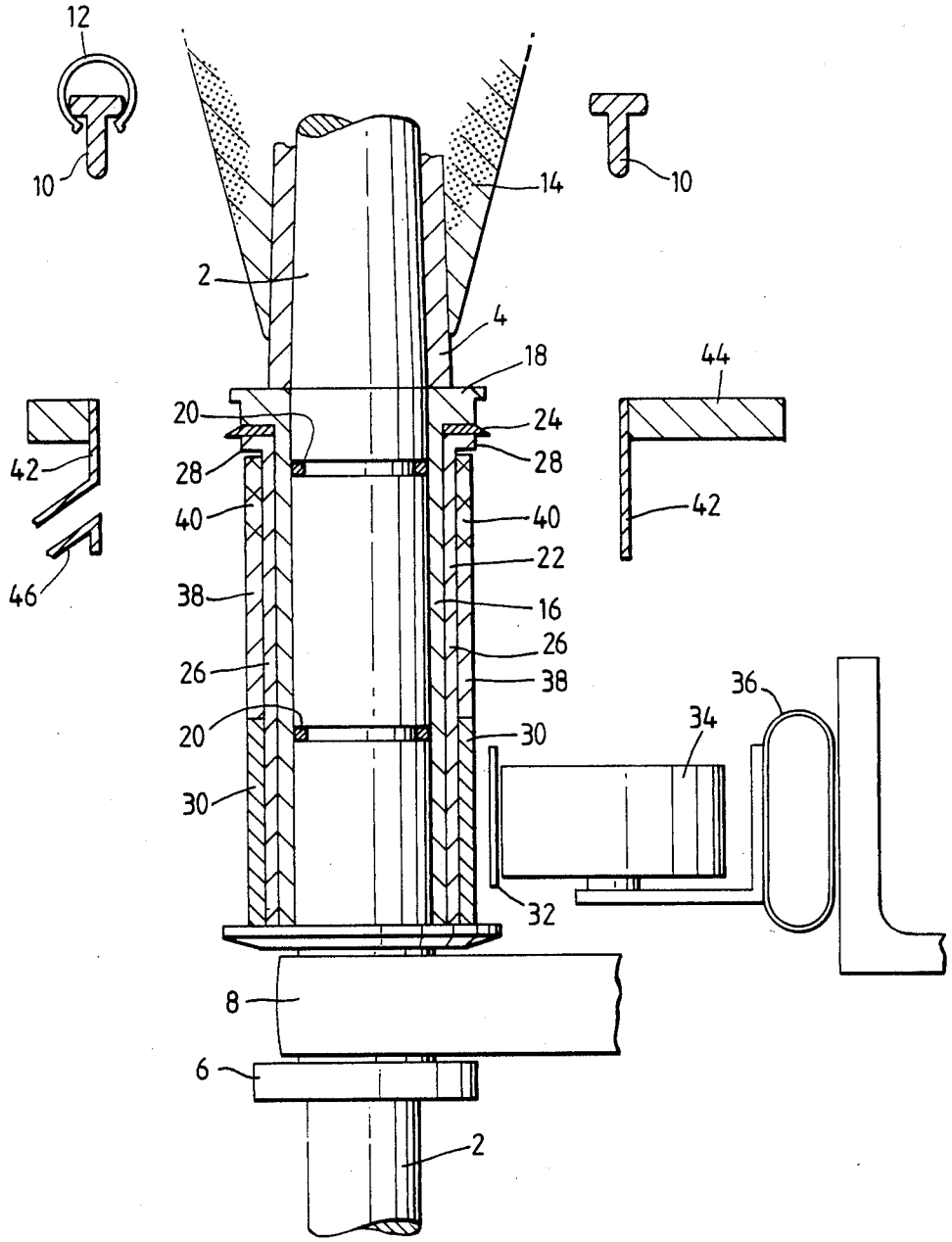

The invention will now be further described by way of example with reference to the accompanying drawings in which:

FIG. 1 is a section through the lower end of one spindle in accordance with the invention of a conventional upright ring spinning machine, FIGS. 2 to 17 are diagrams illustrating the various positions of the parts of the apparatus illustrated in FIG. 1 at the end of the winding of one package and the beginning of winding of a subsequent package, and FIG. 18 is a section similar to FIG. 1 but showing an alternative arrangement.

Referring to FIG. 1 which illustrates the preferable arrangement, the main driven spindle 2 carries a tube or bobbin 4 which is mounted on the spindle for rotation therewith. The spindle has a wharve 6 mounted on its lower end which is engaged by a driven tape or belt (not illustrated in FIG. 1) to rotate the spindle.

A standard ring 10 carrying a traveller 12 is provided for yarn 3 which is fed to the spindle from delivery rollers (not shown) and which acts to twist the fibres together and movement of the ring 10 relative to the spindle in a vertical direction causes, in a conventional manner, the formation of a package 14 on the tube 4.

A removable sleeve 16 having a collar 18 is fixed to the spindle 2, by a screw 17, above the wharve 6 so as to rotate with the spindle. The lower end of the bobbin tube 4 locates against the upper face of the collar 18. A severing blade 24 is fastened to the underside of the collar. The blade 24 may be circular but it could for example be hexagonal and such a shape may assist the severing action.

A tubular reserve winding member 38 is rotatably mounted at its upper end 35 on the sleeve 16 and at its lower end 37 on the spindle above the wharve 6. A gap is present between the inner wall of the reserve winding member and the spindle, but spring loaded buttons 27 which are mounted in the surface of the spindle, project radially outwardly so as to "clutch" the reserve winding member to the spindle to rotate with it during spinning and the winding of the undercoils.

The lower portion of the reserve winding member 38 has a knurled pulley 30 fixed to it which may be engaged by a drive belt 32 to rotate the reserve winding member. The drive belt 32 is normally spaced from the knurled pulley 30 but when it is required to rotate the reserve winding member, a spring loaded jockey pulley 34 is moved against the belt 32 by inflation of a tube 36, so as to force the belt 32 against the pulley 30.

In the normal spinning position, as shown in FIG. 1, the blade 24 of the severing device is guarded by a cover device 42 mounted on a rail 44, there being a number of such devices mounted along the main rail co-operating with the respective spindles of a multi spindle machine.

The rail 44 is movable in a vertical direction between the position as illustrated in FIG. 1 and a lower position in which it is dropped below the blade 24 and a knurled portion 40 of the reserve winding member so as not to obstruct the winding of the reserve windings or undercoils around the knurled portion 40 of the reserve winding member.

The cover 42 surrounds the collar 18, the severing device blade 24 and the reserve winding member portion 40 and is provided with a suction nozzle 46 which in the position illustrated in FIG. 1 is directly opposite the portion 40 of the reserve winding member on which the undercoils are wrapped so that when suction is applied to the nozzle, a cut end of yarn extending from the reserve winding member will be sucked into the nozzle. The member 42 thus serves the dual function of guard and waste end remover.

Referring to FIGS. 2 to 17 the spindle is rotated in a clockwise direction and when the package 14 carried thereon has reached the required size the following sequence of steps occurs.

The numbers in the lefthand column refer to the drawings.

2. The spindle 2 begins to decelerate, the remaining parts of the apparatus being as described hereinbefore with reference to FIG. 1.

3. The guard 42 moves downwardly to expose the blade 24 of the severing device and the knurled portion 40 of the reserve winding member 38.

4. The ring 10 and traveller 12 is moved down below the bottom end of the tube 4, collar 18 of the spindle sleeve 16 and the blade 24 of the severing device, the yarn 3 extending from the traveller up over the collar 18.

5. On continued rotation of the spindle, a few undercoils of yarn (reserve windings) are wound around the knurled portion 40 of the reserve winding member 38, the yarn 3 extending from the bottom of the package 14 across a knurled rim of the collar 18 and the blade 24 to the reserve winding sleeve. The spindle 2 then comes to rest.

6. The tube 36 (see FIG. 1) is inflated by a pneumatic means (not shown) acting to push the pulley 34 against the drive belt 32 causing this to engage the knurled pulley 30 attached to the reserve winding member 38. A motor is then started to drive the belt 32 in an anticlockwise direction and for a limited period, which overcomes the clutching action of the buttons 27 and rotates the reserve winding member 38 in an anticlockwise direction to cause the blade 24 to sever the taut length of yarn 3 extending between the collar 18 and the reserve winding member 38.

7. The air pressure in tube 36 is released so that the spring loaded pulley 34 resumes its former position and exhausts the tube 36. The belt 32 is withdrawn from engagement with the pulley 30. The motor driving the belt is stopped.

8. The package 14 is doffed by an automatic doffing device (not shown).

9. An empty package tube 4' is placed on the spindle 2.

10. The ring and traveller assembly 10, 12 move up to the 'spinning' position adjacent the bottom end of the tube 4'.

11. The spindle 2 is rotated by the main belt 8 for a timed duration so that a few coils of yarn 3 are laid around the empty tube 4'. The yarn 3 from the undercoils now extends in a taut condition across the edge of the severing blade 24 and the knurled ring of the collar 18 to the lower end of the tube 4'.

12. The tube 36 is again inflated causing the jockey pulley 34 to position the belt 32 to drive the pulley 30 of the reserve winding member, but this time in a clockwise direction, to sever the yarn between the undercoils and the initial turns on the new tube 4' and the guard 42 is moved up to surround the blade 24.

13. The belt 32 remains held in contact with the pulley 30 but the motor driving this belt is stopped.

14. The motor driving the belt 32 is re-started to drive the pulley 30 in an anticlockwise direction and the means for providing a suction through nozzle 46 of the yarn cover is energised.

15. The tail end of the undercoils of yarn left wound around the knurled portion 40 of the reserve winding member 38 is sucked in the suction nozzle 46 and as the anticlockswise rotation of the reserve winding member, continues, the undercoils of yarn are unwound from the knurled portion 40 to be sucked down the nozzle 46.

16. The tube 36 is again exhausted, the belt 32 is retracted from the pulley 30 and the air suction on the nozzle 46 is stopped.

17. The main driving motor to the belt 8 to rotate the spindle starts and the normal spinning operation commences.

Figure 13:
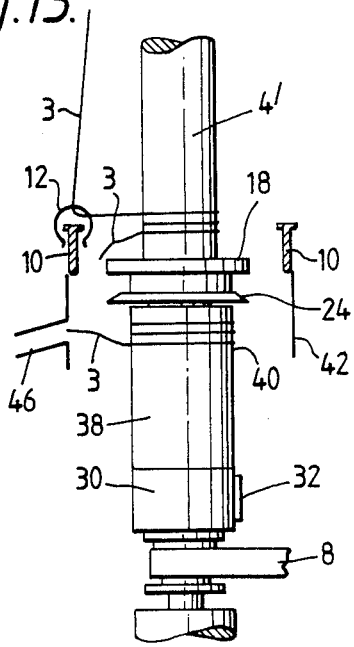
Figure 14:
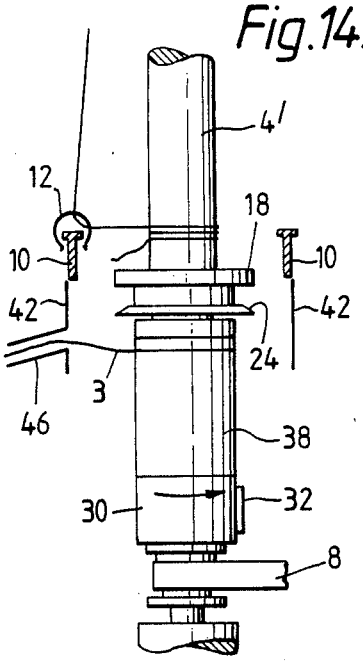
Figure 15:
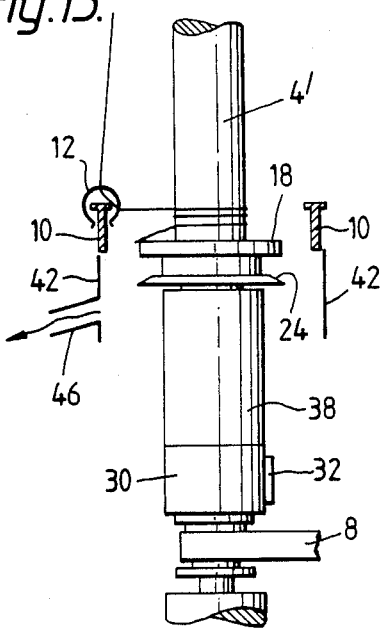
Figure 16:
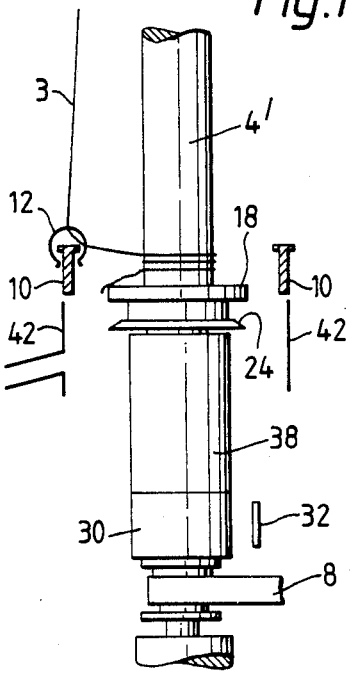
Figure 17:
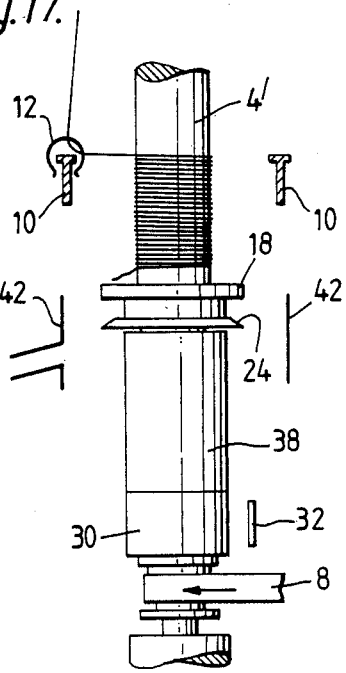

It may be beneficial to include an additional operation between stages 7 and 8 whereby spinning is restarted for a very brief period and the ring rail traversed or reciprocated over the span of the undercoils around the reserve winding member so as to overlay the or part of the tail end of the undercoil which is left after the first severing operation (FIG. 6) so as to ensure that there is no possibility of it becoming entangled with the opposite end of the waste undercoil after the second severing operation (FIG. 12) which might interfere with it being sucked into the nozzle 46 (FIGS. 13 to 15).

Figure 11:
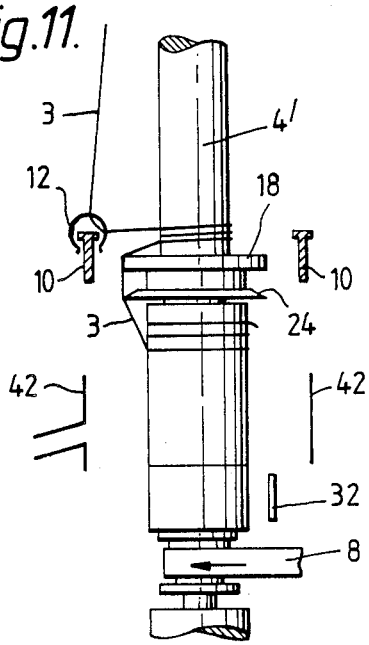
Figure 12:
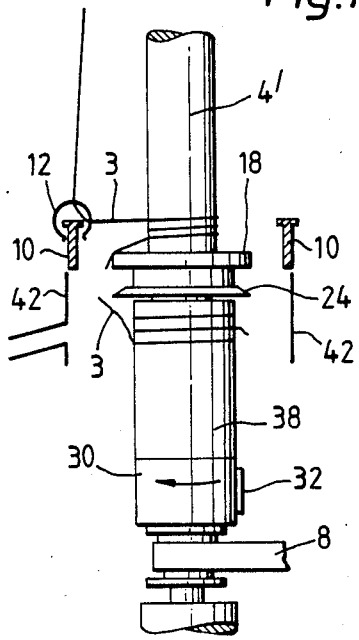

In the construction as illustrated in FIG. 1, the pressure of the buttons 27 against the wall of the bore of the reserve winding member 38 is such that during the normal spinning operation when the package is being wound on the tube 4 and also when the underwindings are being wound around the reserve winding member, and from the reserve winding member to the new tube 4' as shown in FIG. 11, the reserve winding member will rotate with the spindle. However, when the spindle 2 is stopped after the underwindings are wound around the knurled section 40 of the reserve winding member, when belt 32 is engaged with the reserve winding member pulley 30 to rotate it (FIG. 6) the drive from the belt will overcome the clutching power of the buttons 27 and the reserve winding member 38 will rotate thus making the connecting yarn taut and pulling it around the edge of the stationary blade 24 to sever it. After the yarn is severed so as to leave the waste underwindings wrapped around the reserve winding member but unconnected to the tube on the spindle as shown in FIG. 13, the belt 32 drives the reserve winding member pulley 30 in the anticlockwise direction (FIG. 14), so as to unwind the waste undercoils from the reserve winding member. These undercoils are then sucked away through the suction nozzle 46.

It will be appreciated that although it is convenient and uncomplicated to mount the reserve winding member and the severing device on the actual spindle of the apparatus, it would nevertheless be possible to mount it in an external bearing support without contact with the periphery of the spindle other than from the buttons 27.

In the alternative construction illustrated in FIG. 18 a removable sleeve 16 having a collar 18 is located on the spindle 2 above the wharve 6 and is held in a position by 0-rings 20 so as to rotate with the spindle. The lower end of the bobbin tube 4 locates against the upper face of the collar 18.

A severing device 22 having a cutting blade 24 has a tubular sleeve portion 26 which is slideably mounted on the spindle sleeve 16 so as to be rotatable on the spindle sleeve. The blade 24 of the severing device is removable attached to a boss 28 at the upper end of the sleeve portion 26.

The lower portion of the sleeve 26 carries a knurled pulley 30 which may be engaged by a drive belt 32 to rotate the severing device. The drive belt 32 is normally spaced from the knurled pulley 30 but when it is required to rotate the severing device, a spring loaded jockey pulley 34 is moved against the belt 32 by inflation of a tube 36, so as to force the belt 32 against the pulley 30.

A tubular reserve winding member 38 is positioned around the sleeve 26 of the severing device between the collar 28 thereof and the top of the pulley 30, the top portion 40 of the winding member being knurled. The tubular sleeve 38 may rotate around the sleeve 26 and on assembly it will be slid over the sleeve 26 before the pulley 30 is fixed to the lower end of the sleeve 26. Thus the severing device is rotatable on the spindle sleeve 16 and the reserve winding member 38 is rotatable on the severing device sleeve 26 or it can rotate therewith.

The sequence of operations illustrated and described in FIGS. 2 to 17 as related to FIG. 1, apply equally to the construction shown in FIG. 18 except that the blade is rotated relative to the spindle by driving the severing device, rather than the reserve winding member, by the belt 32 so as to cut the yarn by a moving rather than stationary blade, and the rotation of the reserve winding member 38 results from frictional contact between the severing device sleeve 26 and the wall of the bore of the reserve winding member, as described below.

In the construction as illustrated in FIG. 18, the tolerances on the diameter of the spindle sleeve 16 relative to those of the bore of the severing device sleeve 26 and the tolerances on the diameter of the severing device sleeve relative to those of the bore of the reserve winding member 38 are such that during the normal spinning operation when the package is being wound on the tube 4 and also when the underwindings are being wound around the reserve winding member, and from the reserve winding member to the new tube 4' as shown in FIG. 11, the frictional drag between the respective parts will cause them all to rotate with the spindle. However, when the spindle 2 is stopped after the underwindings are wound around the knurled section 40 of the reserve winding member, when belt 32 is engaged with the severing device pulley 30 to rotate the severing device (FIG. 6) the connected underwindings will hold the reserve winding member 38 stationary, thus enabling the blade 24 of the severing device to move across the yarn 3 to sever it. Alternatively a brake (not illustrated) may be applied to hold the reserve winding member stationary. However, after the yarn is severed so as to leave the waste underwindings wrapped around the reserve winding member but unconnected to the tube on the spindle as shown in FIG. 13, the belt 32 drives the severing device pulley 30 in the anticlockwise direction (FIG. 14), and the frictional drag between the severing device and the reserve winding member 38 is such as also to result in the reserve winding member rotating with the severing device so as to unwind the waste undercoils from the reserve winding member. These undercoils are then sucked away through the suction nozzle 46.

The removable spindle sleeve 16 (see FIG. 18) is designed so as to enable the severing device and reserve winding member assembly to be easily removed from the main spindle 2. The diameter of the tube 38 is designed so as to cause the yarn to be at a correct angle across the blade 24 of the severing device when the unwindings are wound on the reserve winding member to enable the yarn to be severed. The rim of the collar 18 is knurled to cause the yarn to cling to it. However, the tube 4 could be formed with a collar to replace that of the spindle sleeve 18 but this would be more susceptible to damage.

What I claim is:

1. Apparatus for automatically winding yarn onto a first bobbin positioned on a spindle to form a wound yarn package and for transferring without interruption the yarn from the wound yarn package on the first bobbin to a replacement bobbin positioned on the spindle, said apparatus comprising:

a spindle for carrying a first bobbin, said spindle being rotatable about its axis to enable yarn to be wound on the first bobbin to form a wound yarn package;

a yarn reserve winding member around which yarn is wound prior to doffing the first bobbin containing the wound yarn package from said spindle;

a yarn severing device located adjacent the axis of said spindle and between said yarn reserve winding member and an adjacent portion of said spindle for cutting the yarn connected between the wound yarn package on the first bobbin on said spindle and a winding on said yarn reserve winding member before doffing the first bobbin containing the wound yarn package from said spindle, and for further cutting the yarn connected between the winding on said yarn reserve winding member and an initial winding on a replacement bobbin positioned on said spindle following doffing of the first bobbin containing the wound yarn package from said spindle;

a first drive means operative for providing rotation of said spindle and said yarn reserve winding member in a first direction to form the wound yarn package on the first bobbin, the winding on said yarn reserve winding member and the initial winding on the replacement bobbin; and a second drive means independently operative of said first drive means for providing rotation of only said yarn reserve winding member in both said first direction and a second direction opposite to said first direction, so that when said yarn reserve winding member is rotated in said second direction independent of said spindle and said first drive means via said second drive means, the yarn connected between the wound yarn package on the first bobbin positioned on said spindle and the winding on said yarn reserve winding member is cut by said yarn severing device prior to doffing the wound yarn package on the first bobbin from said spindle, and when said yarn reserve winding member is rotated in said first direction independent of said spindle and said first drive means via said second drive means, the yarn connected between the winding on said yarn reserve winding member and the initial winding on the replacement bobbin positioned on said spindle is cut by said yarn severing device.

2. Apparatus as claimed in claim 1, said yarn reserve winding member being mounted upon an extension of said spindle beneath the wound yarn package on the first bobbin, said yarn reserve winding member being capable of rotation relative to said spindle.

3. Apparatus as claimed in claim 1, said yarn severing device being fixed to said spindle so as to rotate with it, said yarn reserve winding member being mounted to said spindle so as to rotate with it during the winding of the yarn on said yarn reserve winding member, said yarn reserve winding member being rotatable relative to said spindle in either said first direction or said second direction depending on whether the yarn connected between the winding on said yarn reserve winding member and the initial winding on the replacement bobbin on said spindle or between the wound yarn package on the first bobbin on said spindle and the winding on said yarn reserve winding member, respectively, is to be cut.

4. Apparatus as claimed in claim 1, said yarn severing device being positioned between said yarn reserve winding member and a collar on said spindle located beyond the end of the first or replacement bobbins.

5. Apparatus for automatically winding yarn onto a first bobbin positioned on a spindle to form a wound yarn package and for transferring without interruption the yarn continuing from the wound yarn package on the first bobbin to a replacement bobbin positioned on the spindle, said apparatus comprising:

a spindle for carrying a first bobbin, said spindle being rotatable about its axis to enable yarn to be wound on the first bobbin to form a wound yarn package;

a yarn reserve winding member around which yarn is wound prior to doffing the first bobbin containing the wound yarn package from said spindle;

a yarn severing device located adjacent the axis of said spindle and between said yarn reserve winding member and an adjacent portion of said spindle for cutting yarn connected between the wound yarn package on the first bobbin on said spindle and a winding on said yarn reserve winding member before doffing the first bobbin containing the wound yarn package from said spindle, and for further cutting the yarn connected between the winding on said yarn reserve member and an initial winding on a replacement bobbin donned on said spindle following doffing of the first bobbin containing the wound yarn package from said spindle;

a first drive means operative for providing rotation of said spindle and said yarn reserve winding member in a first direction to form the wound yarn package on the first bobbin, to form the winding on said yarn reserve winding member and to form the initial winding on the replacement bobbin; and a second drive means independently operative of said first drive means for providing rotation of said yarn reserve winding member in both said first direction and in a second direction opposite to said first direction, so that when said yarn reserve winding member is rotated in said second direction independently of said spindle via said second drive means, the yarn connected between the wound yarn package on the first bobbin positioned on said spindle and the winding on said yarn reserve winding member is cut by said yarn severing device prior to doffing the wound yarn package on the first bobbin from said spindle, and when said yarn reserve winding member is rotated in said first direction independent of said spindle via said second drive means, the yarn connected between the winding on said yarn reserve winding member and the initial winding on the replacement bobbin positioned on said spindle is cut by said yarn severing device; and yarn extraction means adjacent said spindle which is operatively positionable relative to said yarn reserve winding member so that the winding on said yarn reserve winding member can be removed therefrom once the yarn connected between the winding on said yarn reserve winding member and the initial winding on the replacement bobbin is cut.

6. Apparatus as claimed in claim 5, said yarn extraction means comprising:

a nozzle through which suction is applied to suck yarn unwound from said yarn reserve winding member into said nozzle for disposal.

7. Apparatus as claimed in claim 5, said yarn extraction means comprising:

a guard device for guarding said yarn severing device during the formation of the wound yarn package, said guard device being movable axially of said spindle from a position opposite said yarn severing device to a position below it so as to expose said yarn reserve winding member and to facilitate the transfer of the yarn from the yarn wound package on the first bobbin on said spindle onto said yarn reserve winding member.

8. Apparatus for winding yarn onto a yarn support tube, said apparatus comprising a spindle for carrying said support tube or a replacement tube, said spindle being rotatable about its axis to enable yarn to be wound on said support tube or said replacement tube to form a wound package, a yarn reserve winding member around which yarn continuing from the wound package is wound prior to doffing the wound package from said spindle, a yarn severing device located between an adjacent portion of said spindle and said yarn reserve winding member so as to engage each length of yarn connecting the yarn wound on said yarn support tube and the yarn wound on said yarn reserve winding member or to engage each length of yarn connecting the yarn wound on said yarn reserve winding member and the yarn wound on said replacement tube donned on said spindle subsequent to doffing the wound package on said support tube from said spindle, and drive means for providing selective rotation of said spindle to form a wound package on said support tube or said replacement tube and for providing selective rotation of said yarn reserve winding member in a first direction or in a direction opposite to said first direction, so that when said drive means is selectively operated to rotate said yarn reserve winding member in said opposite direction the length of yarn extending between the wound package on said support tube and on said yarn reserve winding member is cut via said yarn severing device, and when said drive means is selectively operated to rotate said yarn reserve winding member in said first direction the length of yarn extending between said yarn reserve winding member and said replacement tube donned on said spindle is cut via said yarn severing device.

9. Apparatus as claimed in claim 8, said drive means being operative for further selective rotation of said yarn reserve winding member in said opposite direction after the yarn extending between said yarn reserve winding member and said replacement tube is cut, so that the yarn wrapped around said yarn reserve winding member is unwound.

10. Apparatus as claimed in claim 8, said drive means comprising clutching means for permitting said drive means to selectively rotate said yarn reserve winding member in said first direction or said opposite direction free of rotation of said spindle.

11. Apparatus as claimed in claim 8, said apparatus further comprising suction means for sucking away yarn wound on said yarn reserve winding member once the yarn extending from said yarn reserve winding member to the replacement tube is cut.

12. A machine for winding yarn onto a plurality of yarn support tubes, said machine comprising:

a plurality of spindles each for carrying a yarn support tube, each said yarn support tube being rotatable about the axis of a said spindle on which it is donned so as to wind yarn onto each said yarn support tube to form a yarn package thereon;

a yarn reserve winding member corresponding to each said spindle around which yarn extending from the respective yarn package is wound to form a winding thereon prior to doffing the respective yarn package from said corresponding spindle;

a yarn severing device positioned between an adjacent portion of each said spindle and a corresponding said yarn reserve winding member for engaging the yarn extending between the winding on said corresponding yarn reserve winding member and the respective yarn package on said support tube donned on said corresponding spindle or an initial winding formed on a replacement yarn support tube donned on said corresponding spindle subsequent to doffing therefrom the respective yarn package;

drive means common to the plurality of said spindles for providing selective rotation of said support tubes donned on said spindles in a first direction to form the yarn packages thereon and to the plurality of said corresponding yarn reserve winding members for providing selective rotation of said yarn reserve winding members in either said first direction or a direction opposite to said first direction, so that once said drive means is operated to selectively rotate said spindles and said corresponding yarn reserve winding members in said first direction to form the yarn packages and windings thereon, respectively, said drive means is operated to selectively rotate said yarn reserve winding members in said opposite direction to cut the yarns extending between the respective yarn packages on said corresponding support tubes and the windings on said corresponding yarn reserve winding members with said corresponding yarn severing devices, and said drive means is further operated to selectively rotate said yarn reserve winding members in said first direction to cut the yarns extending between the windings on said corresponding yarn reserve winding members and the initial windings on said respective replacement yarn support tubes donned on said corresponding spindles with said corresponding yarn severing devices; and suction means associated with each said yarn reserve winding member for sucking away the windings as they are unwound from each said corresponding yarn reserve winding member by selectively rotating each said yarn reserve winding member in said opposite direction via said drive means once the yarns connected between the windings on each said yarn reserve winding member and the initial windings on each said corresponding replacement yarn support tube on each said respective spindle has been cut.

* * * * *